US012232601B1

(12) United States Patent
Fogel

(10) Patent No.: US 12,232,601 B1
(45) Date of Patent: Feb. 25, 2025

(54) LAPTOP SUPPORT DEVICE

(71) Applicant: Marc H. Fogel, Simsbury, CT (US)

(72) Inventor: Marc H. Fogel, Simsbury, CT (US)

( * ) Notice: Subject to any disclaimer, the term of this patent is extended or adjusted under 35 U.S.C. 154(b) by 0 days.

(21) Appl. No.: 18/812,393

(22) Filed: Aug. 22, 2024

(51) Int. Cl.
*A45F 5/00* (2006.01)

(52) U.S. Cl.
CPC ..... *A45F 5/00* (2013.01); *A45F 2005/006* (2013.01); *A45F 2200/0525* (2013.01)

(58) Field of Classification Search
CPC ..... A45F 2005/006; A45F 2200/0525; A47B 23/002; A47G 23/0608; G06F 1/163; A45C 2011/003
See application file for complete search history.

(56) References Cited

U.S. PATENT DOCUMENTS

| | | | | |
|---|---|---|---|---|
| 128,739 | A * | 7/1872 | Mahan | A47B 23/002 108/131 |
| 3,090,330 | A * | 5/1963 | Best | A45F 5/00 108/135 |
| 6,213,363 | B1 | 4/2001 | Norberg | |
| 6,349,864 | B1 * | 2/2002 | Lee | A45F 3/14 224/265 |
| 6,883,694 | B2 * | 4/2005 | Abelow | G06F 1/163 361/679.55 |
| 7,780,049 | B1 * | 8/2010 | Baranoski | A45F 3/14 248/323 |
| 8,091,486 | B1 * | 1/2012 | Broaddrick | A47B 23/002 248/444 |
| 8,844,448 | B2 * | 9/2014 | Allen | A47B 23/002 108/43 |
| 9,107,525 | B1 * | 8/2015 | Ogle | A47G 23/06 |
| 9,661,918 | B2 | 5/2017 | Janowski et al. | |
| 10,159,329 | B1 | 12/2018 | Lang et al. | |
| 10,317,941 | B2 | 6/2019 | Janowski et al. | |
| 2005/0178809 | A1 | 8/2005 | Allison | |
| 2006/0092141 | A1 * | 5/2006 | Amani | A47B 23/002 345/173 |
| 2011/0108597 | A1 | 5/2011 | Kunow et al. | |
| 2015/0223590 | A1 | 8/2015 | Arias-Tabima | |
| 2021/0153644 | A1 | 5/2021 | Pierre | |
| 2022/0287454 | A1 | 9/2022 | Wescott, Sr. | |
| 2023/0380578 | A1 | 11/2023 | Goodloe, Sr. | |

FOREIGN PATENT DOCUMENTS

| | | | |
|---|---|---|---|
| CN | 2916732 | Y | 6/2007 |
| JP | 2005255410 | A | 9/2005 |
| WO | 2022087545 | A1 | 4/2022 |

OTHER PUBLICATIONS

Travel Tray, Toddler Car Seat Lap Tray, Road Trip Essentials Activity Table; Amazon; Kenley Kids Store; retrieved Oct. 10, 2024; https://www.amazon.com/gp/aw/d/B07GJZBBT1.

* cited by examiner

*Primary Examiner* — Adam J Waggenspack
(74) *Attorney, Agent, or Firm* — CANTOR COLBURN LLP

(57) ABSTRACT

A laptop support device defines a forward direction, a rearward direction, a rightward direction, a leftward direction, an upward direction, and a downward direction, and includes a main body shaped as a planar structure and comprising an upper surface that faces the upward direction and that is configured to hold a laptop computer, and a tension support strap configured to be attached to the main body that is configured to wrap around a user such that the tension support strap is tensioned between the main body and the user.

20 Claims, 6 Drawing Sheets

LAPTOP SUPPORT DEVICE

BACKGROUND

The present disclosure relates to a laptop support device. A device that facilitates the use of a laptop computer is desirable.

SUMMARY

In accordance with a non-limiting example, a laptop support device defines a forward direction, a rearward direction, a rightward direction, a leftward direction, an upward direction, and a downward direction, and comprises a main body shaped as a planar structure and comprising an upper surface that faces the upward direction and that is configured to hold a laptop computer; and a tension support strap configured to be attached to the main body that is configured to wrap around a user such that the tension support strap is tensioned between the main body and the user.

In addition to one or more of the features described herein, the tension support strap is attached to the upper surface of the main body.

In addition to one or more of the features described herein, the tension support strap is attached to the upper surface at two locations that are within a rear 20% of the upper surface.

In addition to one or more of the features described herein, the tension support strap is attached to the upper surface at two locations that are within a rear 10% of the upper surface.

In addition to one or more of the features described herein, the laptop support device comprises a backstop structure comprising a vertical portion configured to abut a rear end of the laptop computer to prevent the laptop computer from sliding in the rearward direction.

In addition to one or more of the features described herein, the backstop structure is positioned within a rear 20% of the upper surface.

In addition to one or more of the features described herein, the backstop structure is positioned within a rear 10% of the upper surface.

In addition to one or more of the features described herein, the backstop structure extends upward from a rear edge of the main body.

In addition to one or more of the features described herein, a forward edge of the main body is curved.

In addition to one or more of the features described herein, the laptop support device comprises a first attachment structure configured to attach to a first end of the tension support strap, and a second attachment structure configured to attach to a second end of the tension support strap.

In addition to one or more of the features described herein, the laptop support device comprises a removable clasp structure disposed on the second attachment structure or the second end of the support strap.

In addition to one or more of the features described herein, the removable clasp structure is a snap hook.

In addition to one or more of the features described herein, the first attachment structure comprises a first ring portion configured to connect to a first attachment ring disposed at the first end of the tension support strap.

In addition to one or more of the features described herein, the second attachment structure comprises a second ring portion configured to connect to a second attachment ring disposed at the end of the tension support strap with the removable clasp structure therebetween.

In addition to one or more of the features described herein, the tension support strap is configured to be substantially parallel to the main body when in tensioned against the user.

In addition to one or more of the features described herein, the tension support strap comprises a strap body and a length adjustment mechanism configured to adjust a length of the strap body.

In addition to one or more of the features described herein, the vertical portion of the backstop structure extends directly from the upper surface of the main body.

In addition to one or more of the features described herein, the vertical portion of the backstop structure is formed integrally with the main body.

In addition to one or more of the features described herein, the vertical portion of the backstop structure is rotatably mounted on the main body via a hinge and configured to rotate between a vertical position and a folded position.

In accordance with a non-limiting example, a laptop support device defines a forward direction, a rearward direction, a rightward direction, a leftward direction, an upward direction, and a downward direction, and comprises a main body shaped as a planar structure and comprising an upper surface that faces the upward direction and that is configured to hold a laptop computer, and a forward edge that is curved, a backstop structure formed on the upper surface of the main body and positioned within a rear 10% of the upper surface, the backstop structure comprising a vertical portion configured to abut a rear end of the laptop computer to prevent the laptop computer from sliding in the rearward direction, a tension support strap configured to be attached to the upper surface of the main body at two locations that are within the rear 10% of the upper surface, the tension support strap being configured to wrap around a user such that the tension support strap is tensioned between the main body and the user, the tension support strap comprising a strap body and a length adjustment mechanism configured to adjust a length of the strap body, and the tension support strap being configured to be substantially parallel to the main body when in tensioned against the user, a first attachment structure configured to attach to a first end of the tension support strap and comprising a first ring portion configured to connect to a first attachment ring disposed at the first end of the tension support strap, and a second attachment structure configured to attach to a second end of the tension support strap and comprising a second ring portion configured to connect to a second attachment ring disposed at the end of the tension support strap with a removable clasp structure structured as a snap hook therebetween.

The above features and advantages, and other features and advantages of the disclosure are readily apparent from the following detailed description when taken in connection with the accompanying drawings.

DETAILED DESCRIPTION

Figure 1:
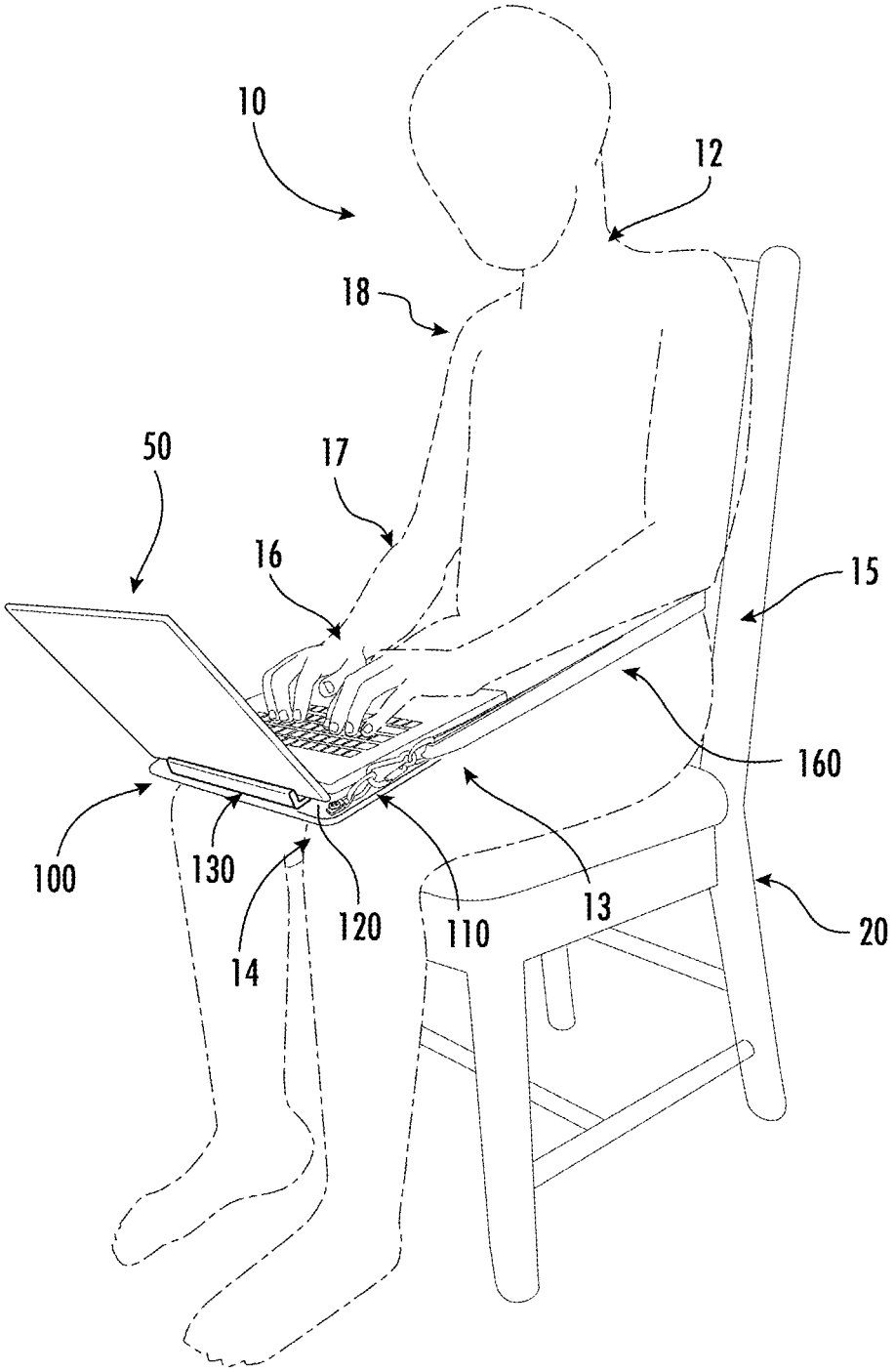
FIG. 1 shows a user with a laptop computer supported by a laptop support device according to one or more embodiments.

The following description is merely exemplary in nature and is not intended to limit the present disclosure, its application or uses. It should be understood that throughout the drawings, corresponding reference numerals indicate like or corresponding parts and features.

FIG. 1 shows a user 10 with a laptop computer 50 supported on a laptop support device 100 according to a non-limiting example. The user 10 may be in a sitting position, for example, on a chair 20. A main body 110 of the laptop support device 100 may rest on a lap 13 of the user 10, and a tension support strap 160 extending from the main body 110 may wrap around a lower back 15 of the user 10. Alternatively, the tension support strap 160 may be structured to additionally or alternatively wrap around other portions of the user 10 (e.g., neck 12, shoulders 18, etc.). The laptop computer 50 may be supported by an upper surface 120 of the main body 110 of the laptop support device 100. A backstop structure 130 extending upward from the upper surface 120 may abut a rear portion of the laptop computer 50.

When the user 10 is in a sitting position as shown in FIG. 1, the lap 13 of the user 10 tends to slope downward towards knees 14 of the user 10. Thus, a laptop computer 50 resting directly on the lap 13 of the user 10 may risk sliding down towards the knees 14, and risks falling off of the lap 13. While the user 10 may lift the knees 14 to avoid this, doing so may result in an unnatural position for the user 10 and may result in strain on the user 10. The user 10 may also place an object on the lap 13 near the knees 14 to lift the rear portion of the laptop computer 50 such that the laptop computer 50 is angled towards the user 10. However, this results in an unnatural bending of the wrists 16 and, furthermore, may cause a cramped configuration for the wrists 16, the arms 17, and/or the shoulders 18 of the user 10. Further, the user 10 may be required to bend the neck 12 and/or the back to unnatural positions. These unnatural positions may result in fatigue and/or injury for the user 10.

According to one or more embodiments, as shown in FIG. 1, the laptop computer 50 is supported by the laptop support device 100 such that the base thereof is parallel to the lap 13 of the user 10. Thus, the keyboard and/or the screen of the laptop computer 50 may be angled away from the user 10. This is a natural and comfortable position for the user 10, preventing unnatural bending of the wrists 16 or unnatural positions of the wrists 16, arms 17, shoulders 18, and/or neck 12. While a gravitational force acts on the laptop computer 50 towards a direction of the knees 14 of the user 10, the backstop structure 130 abuts the rear portion of the laptop computer 50 to prevent sliding of the laptop computer 50. Furthermore, while the gravitational force acting on the laptop computer 50 and the laptop support device 100 biases the laptop computer 50 and the laptop support device 100 towards the direction of the knees 14 of the user 10, the tension support strap 160 extending from the upper surface 120 of the main body 110 of the laptop support device 100 and wrapped around the lower back 15 of the user 10 prevents the laptop computer 50 and the laptop support device 100 from sliding. As shown in FIG. 1, the tension support strap 160 may be wrapped around the lower back 15 of the user 10 so as to be substantially parallel to the main body 110. This configuration of the tension support strap 160 may prevent unwanted moments acting on the main body 110 that could flip the body 110, resulting in damage to the laptop computer 50 and/or injury to the user 10. Furthermore, the laptop support device 100 may position the laptop computer 50 on the lap 13 of the user 10 such that a base portion of the laptop computer 50 (e.g., the keyboard) is angled away from the user 10. Because laptop computers 50 generally allow a display to fold to form an angle with the base portion between 0° and 90°, the laptop support device 100 may allow the angle to be adjusted such that the display is substantially perpendicular to the user 10.

FIGS. 2-5 show a laptop support device 100 according to one or more embodiments. The laptop support device 100 defines a forward direction F, a rearward or backward direction B, a leftward direction L, a rightward direction R, an upward direction U, and a downward direction D. The laptop support device 100 has a main body 110 that is a substantially planar structure that defines a forward edge 111, a rear edge 113, a left edge 115, a right edge 117, a lower surface 119, and an upper surface 120. The forward edge 111, the rear edge 113, the left edge 115, and the right edge 117 may be curved without any sharp edges or corners such to prevent injury to the user 10 during use.

The main body 110 may be formed of plastic, carbon fiber, aluminum, or any other material known in the art that has sufficient strength to support the weight of a laptop computer 50. According to one or more embodiments, the main body may be formed of multiple layers of different materials. As a non-limiting example, an uppermost layer may be formed of a thermally conductive material to dissipate heat away from the laptop computer 50. As a non-limiting example, an uppermost layer may be formed of a material that prevents the laptop computer 50 from sliding, e.g., rubber. As a non-limiting example, a lowermost layer may be formed of a material that prevents the laptop support device 100 from sliding off of the lap 13 of the user 10, e.g., rubber. Alternatively, one or more gripping structures made of, for example, rubber, may be formed on the upper surface 120 of the main body 110. As a non-limiting example, a lowermost layer may be formed of a material with low thermal conductivity so that heat from the laptop computer 50 is not conducted to the lap 13 of the user 10. As a non-limiting example, the lowermost layer may be formed of a soft and/or cushioning material for comfort of the user 10. As a non-limiting example, the main body 110 may also include an intermediate layer that provides strength to the main body 110, for example, plastic, carbon fiber, aluminum, or other materials known in the art.

Figure 7:
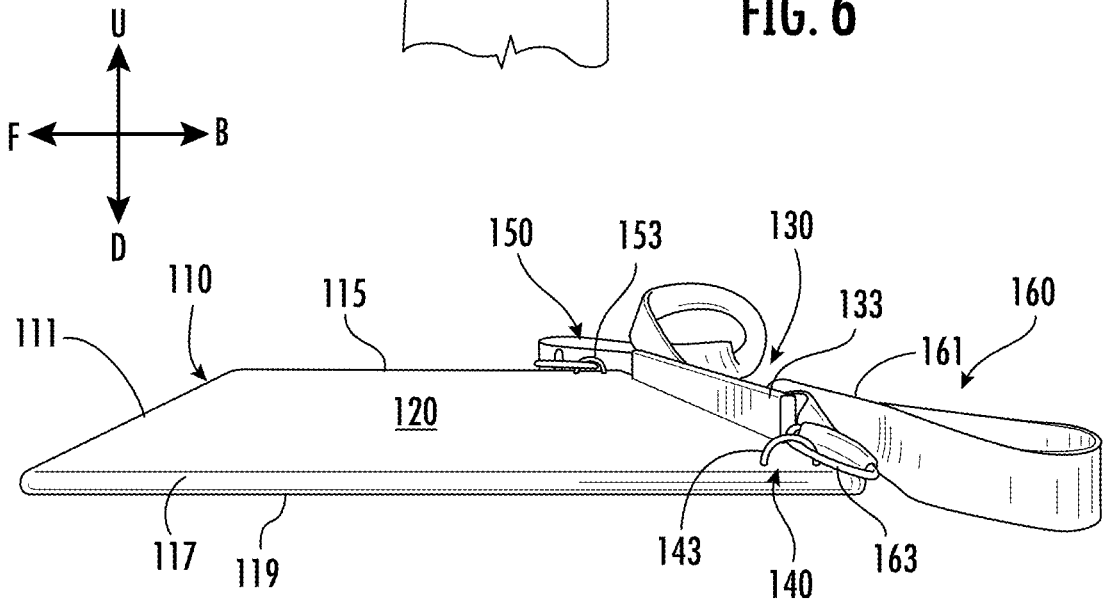
FIG. 7 shows a side view of a laptop support device according to one or more embodiments.

The laptop support device 100 may further include a backstop structure 130 extending upward from the upper surface 120 of the main body 110. Alternatively, the backstop structure 130 may extend from the rear edge 113 of the main body 110. As shown in FIGS. 2-5, the backstop structure 130 may include a base portion 131 attached to the upper surface 120 of the main body 110 and a vertical portion 133 extending in the upper direction U from the base portion 131. The vertical portion 133 may be spaced from the rear edge 113 or, alternatively, may be positioned to be flush with the rear edge 113. According to one or more embodiments, as shown in FIG. 7, the backstop structure 130 may omit the base portion 131 such that the vertical portion 133 may extend directly upward from the upper surface 120 of the main body 110. The backstop structure 130 may be a separate structure from the main body 110 that is attached thereto or, alternatively, may be formed integrally with the main body 110.

The laptop support device 100 may further include a first attachment structure 140 and a second attachment structure 150 on the upper surface 120 of the main body 110. The first attachment structure 140 may include a first base portion 141 that is attached to the upper surface 120 of the main body 110 via a first fastener 142 (e.g., a screw) and a first ring portion 143 extending upward from the first base portion 141. The second attachment structure 150 may include a second base portion 151 that is attached to the upper surface 120 of the main body 110 via a second fastener 152 (e.g., a screw) and a second ring portion 153 extending upward from the second base portion 151. The second attachment structure 150 may further include a ring 155 attached to the second ring portion 153 and a removable clasp structure 157 attached to the ring 155. The removable clasp structure 157 may be, for example, a snap hook. Alternatively, the second ring portion 153 may be sufficiently large to directly accommodate the removable clasp structure 157 such that the ring 155 may be omitted. The first base portion 141 of the first attachment structure 140 and the second base portion 151 of the second attachment structure 150 may be stationary or may be rotatable about the first and second fasteners 142, 152. While FIGS. 1-6 show the first attachment structure 140 and the second attachment structure 150 being attached to the upper surface 120 of the main body by first and second fasteners 142, 152, as shown in FIG. 7, the first ring portion 143 of the first attachment structure 140 and the second ring portion 153 of the second attachment structure 150 may be formed directly on the upper surface 120 of the main body 110. According to one or more embodiments, the first ring portion 143 of the first attachment structure 140 and the second ring portion 153 of the second attachment structure 150 may be formed integrally with the main body 110.

According to one or more embodiments, an entirety of the first attachment structure 140 and/or an entirety of the second attachment structure 150 may be disposed on a rear 20% of the upper surface 120. According to one or more embodiments, an entirety of the first attachment structure 140 and/or an entirety of the second attachment structure 150 may be disposed on a rear 10% of the upper surface 120. According to one or more embodiments, an entirety of the first attachment structure 140 may be disposed on a right 20% of the upper surface 120. According to one or more embodiments, an entirety of the first attachment structure 140 may be disposed on a right 10% of the upper surface 120. According to one or more embodiments, an entirety of the second attachment structure 150 may be disposed on a left 20% of the upper surface 120. According to one or more embodiments, an entirety of the second attachment structure 150 may be disposed on a left 10% of the upper surface 120. According to one or more embodiments, an entirety of the backstop structure 130 may be disposed on a rear 20% of the upper surface 120. According to one or more embodiments, an entirety of the backstop structure 130 may be disposed on a rear 10% of the upper surface 120.

Figure 2:
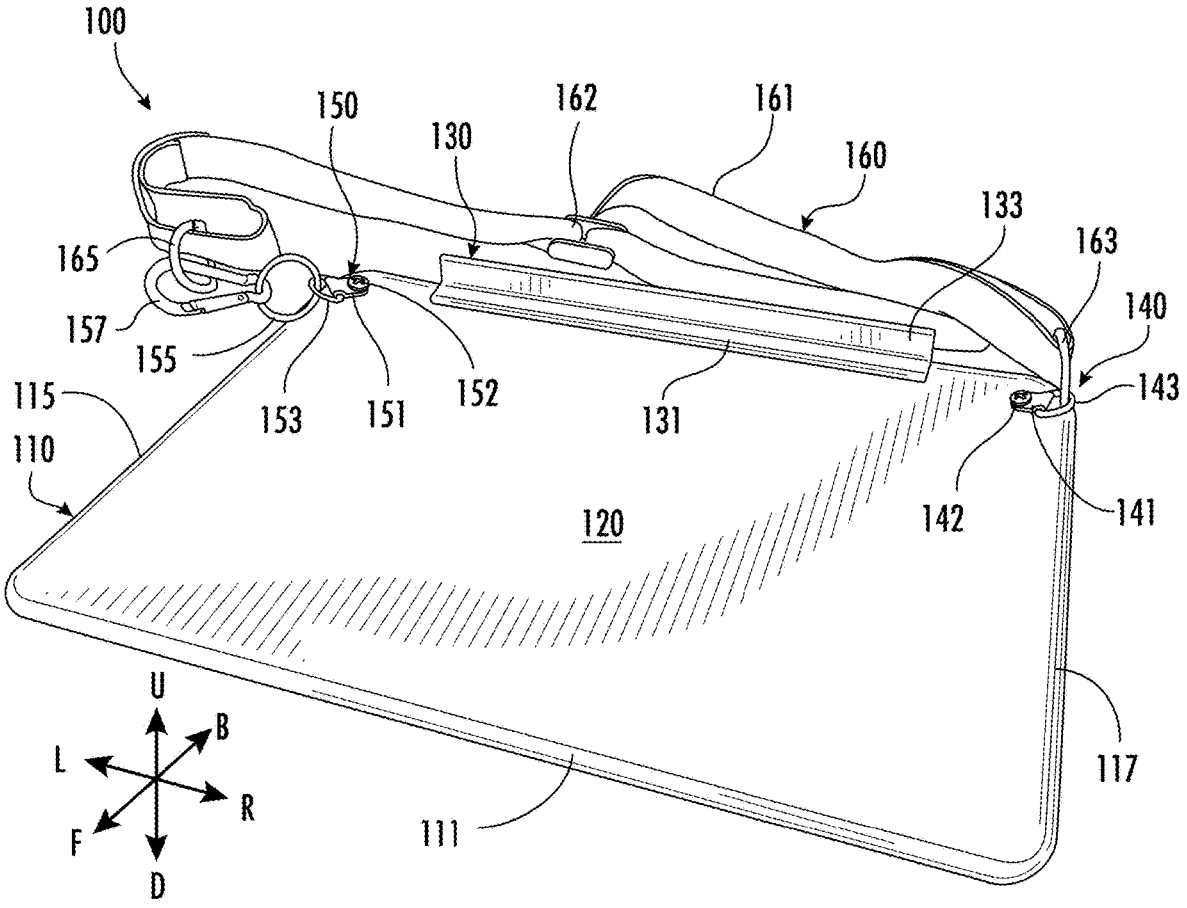
FIG. 2 shows a perspective view of the laptop support device according to one or more embodiments.
Figure 3:
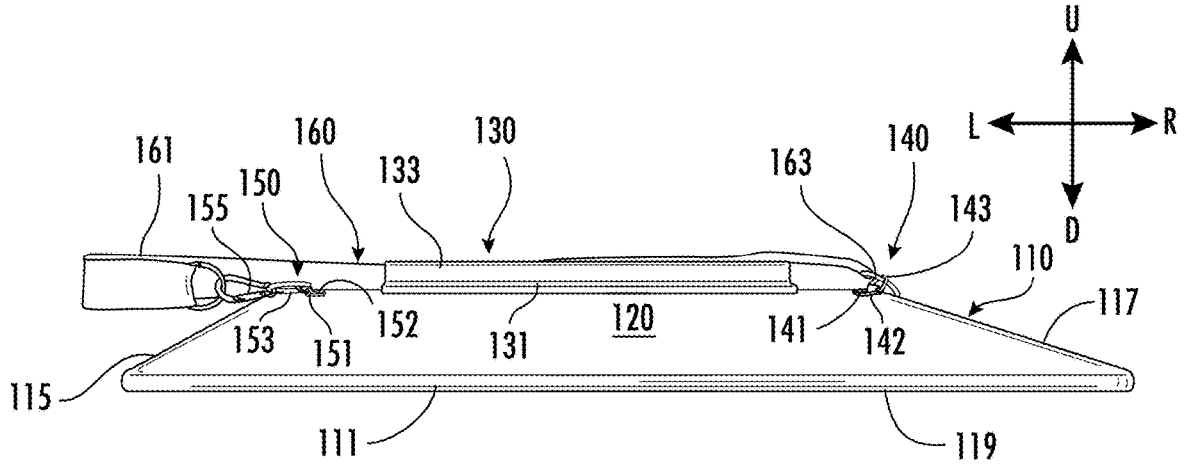
FIG. 3 shows a front view of the laptop support device of FIG. 2.
Figure 4:
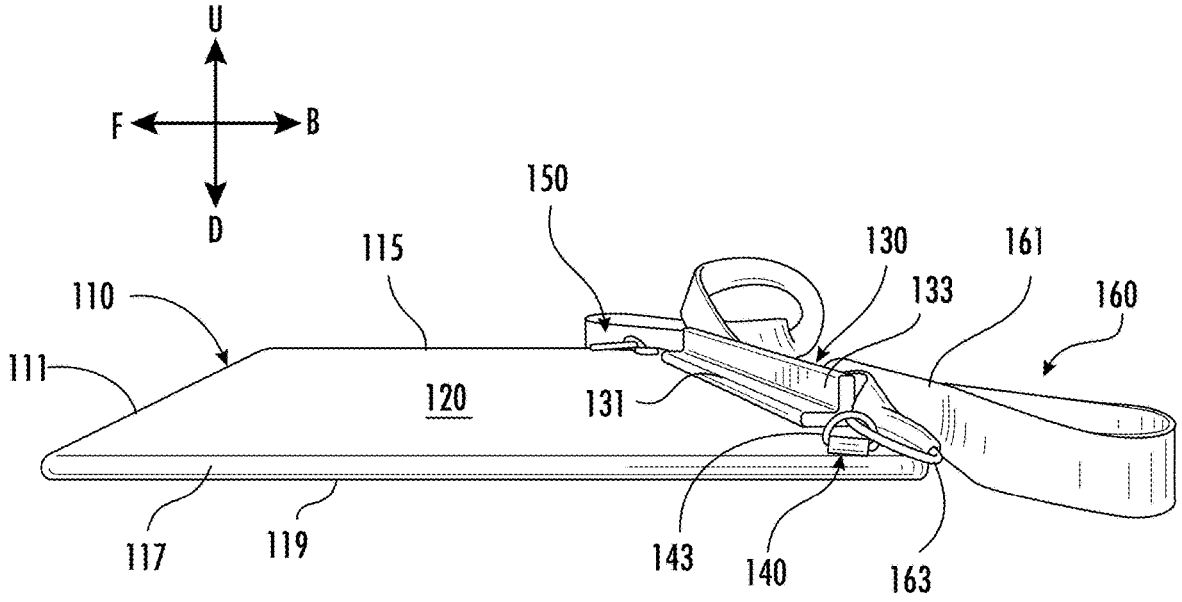
FIG. 4 shows a side view of the laptop support device of FIG. 2.
Figure 5:
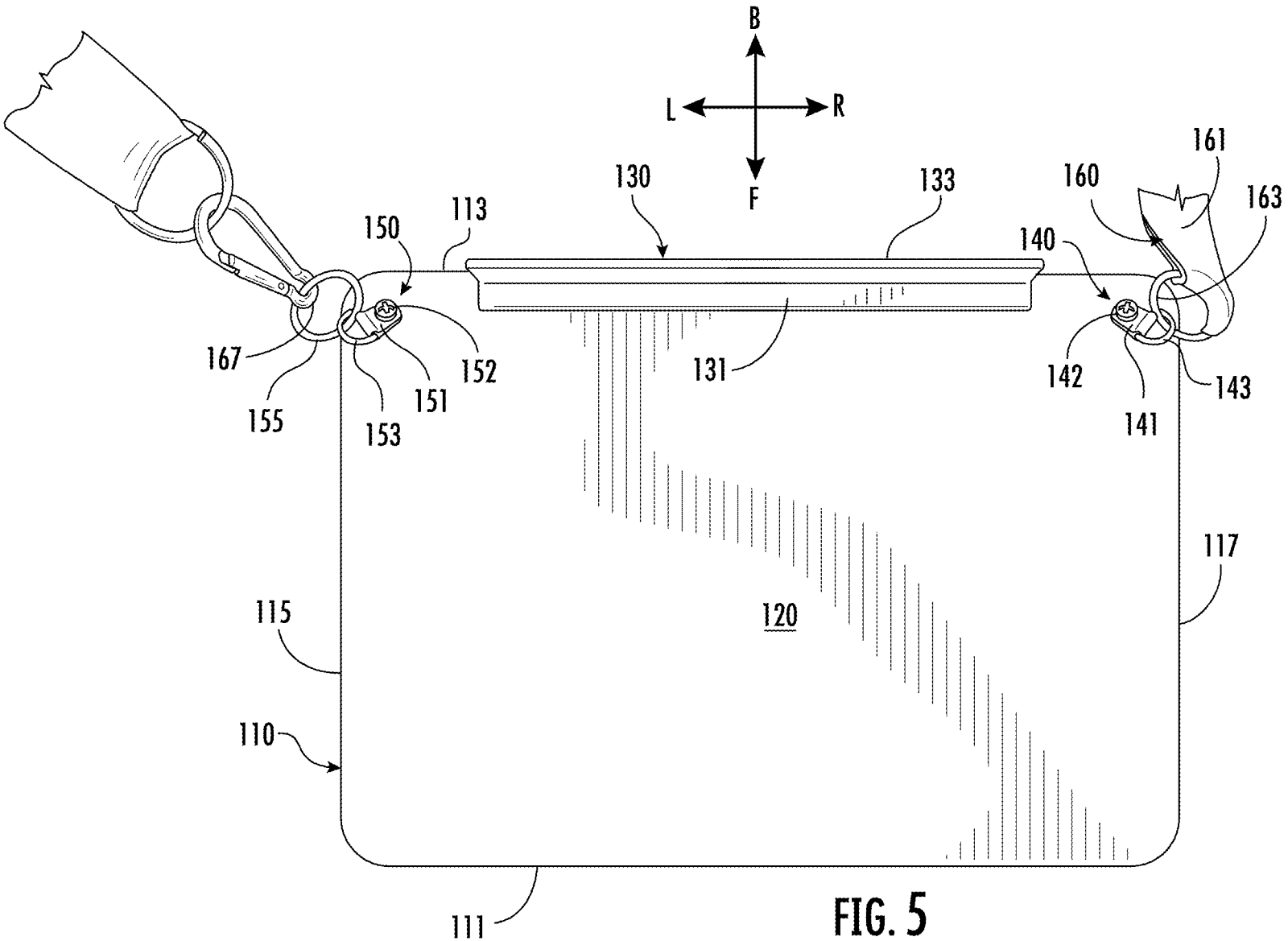
FIG. 5 shows a top view of the laptop support device of FIG. 2.
Figure 6:
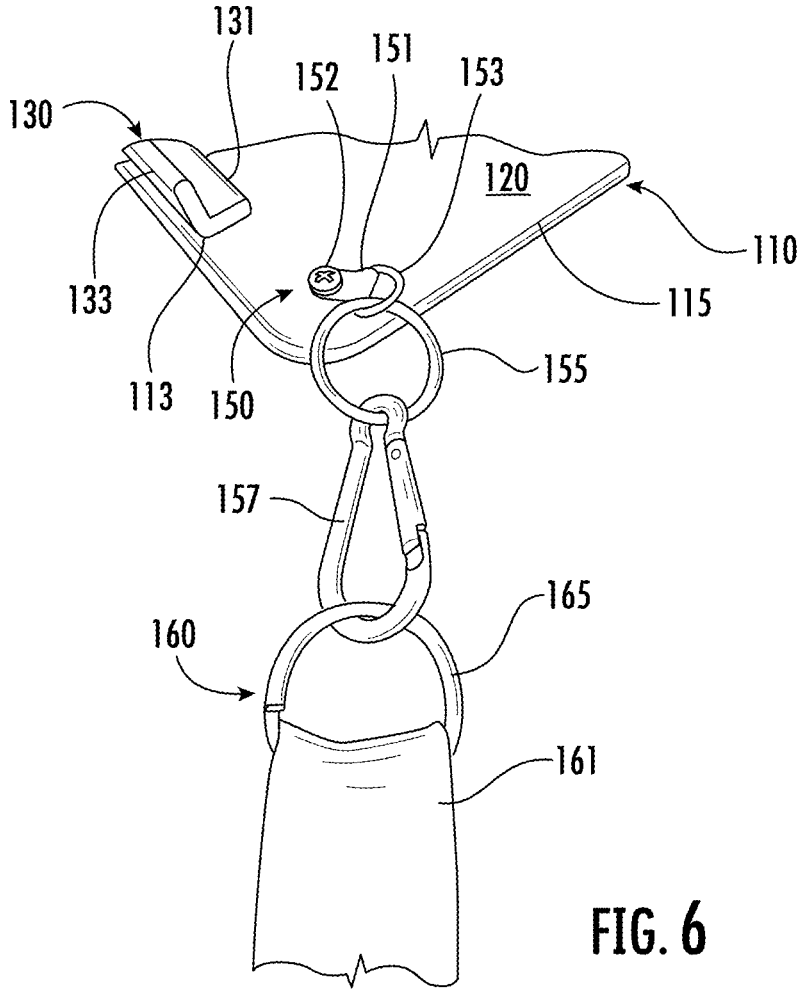
FIG. 6 shows a strap engagement structure of the laptop support device of FIG. 2.

The laptop support device 100 may further include a tension support strap 160. The tension support strap 160 includes a strap body 161 that extends between a first attachment ring 163 and a second attachment ring 165. The first attachment ring 163 may be attached to the first ring portion 143 of the first attachment structure 140. The user 10 may wrap the tension support strap 160 around the lower back 15 as shown in FIG. 1 and attach the removable clasp structure 157 to the second attachment ring 165 as shown in FIG. 6. According to one or more embodiments, as shown in FIG. 2, the removable clasp structure 157 may instead stay on the second attachment ring 165 such that, after wrapping the tension support strap 160 around the lower back 15, the user 10 may attach the removable clasp structure 157 onto the ring 155 or the second ring portion 153. The tension support strap 160 may further include a length adjustment mechanism 162 disposed on the strap body 161 that is structured to allow the user 10 to adjust the length of the strap body 161.

Figure 8:
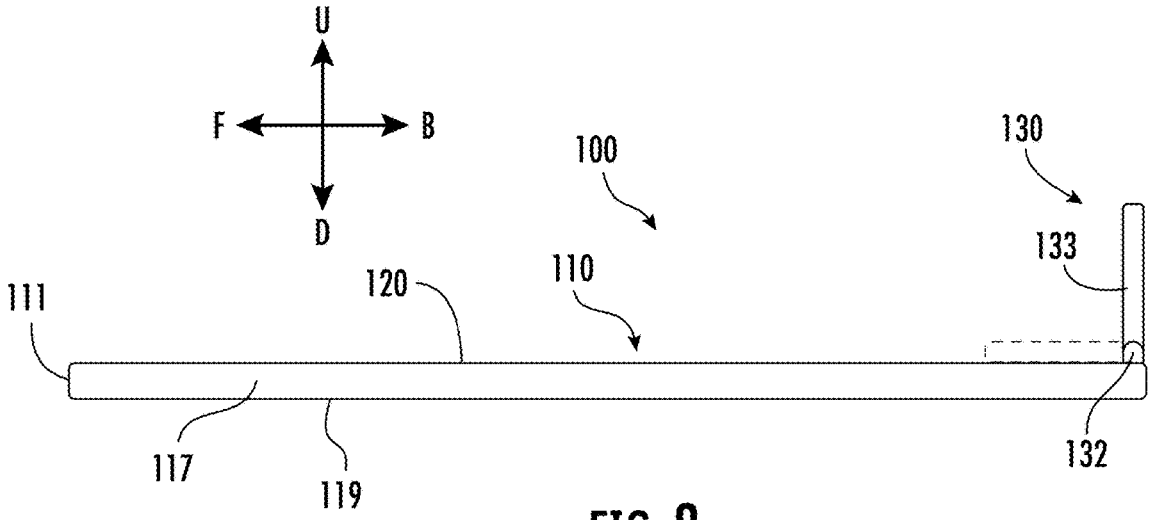
FIG. 8 shows a schematic side view of a laptop support device according to one or more embodiments.

FIG. 8 shows a schematic side view of laptop support device 100 according to one or more embodiments. As shown in FIG. 8, the backstop structure 130 may include a vertical portion 133 attached to the top surface 120 of the main body 110 via a hinge 132 such that the vertical portion 133 is foldable from a vertical position shown in solid lines a folded position shown in dashed lines. In the folded position, the vertical portion 133 may be substantially parallel to the upper surface 120. According to one or more embodiments, because the vertical portion 133 shown in FIG. 8 is foldable, the vertical portion 133 may be made taller than in the embodiments shown in FIGS. 1-7.

Figure 9:
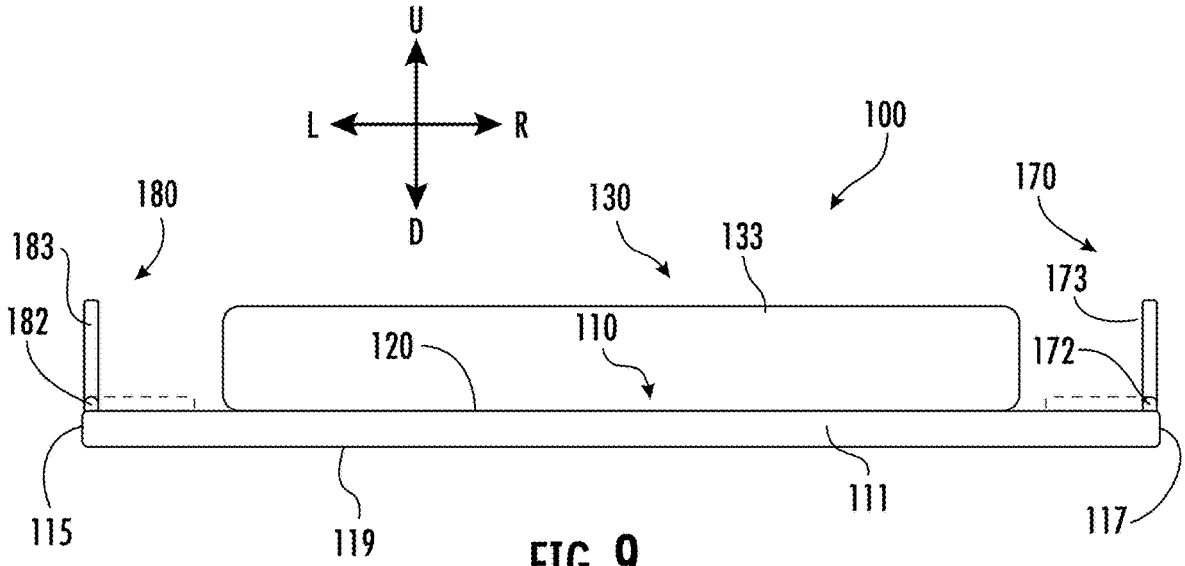
FIG. 9 shows a schematic front view of a laptop support device according to one or more embodiments.

FIG. 9 shows a schematic front view of laptop support device 100 according to one or more embodiments. As shown in FIG. 9, the laptop support device 100 may include a right stopper structure 170 on the right edge 117 or on the upper surface 120 at or near the right edge 117. The right stopper structure 170 may include a vertical portion 173 attached to the top surface 120 of the main body 110 via a hinge 172 such that the vertical portion 173 is foldable from a vertical position shown in solid lines a folded position shown in dashed lines. In the folded position, the vertical portion 173 may be substantially parallel to the upper surface 120. The laptop support device 100 may include a left stopper structure 180 on the left edge 115 or on the upper surface 120 at or near the left edge 115. The left stopper structure 180 may include a vertical portion 183 attached to the top surface 120 of the main body 110 via a hinge 182 such that the vertical portion 183 is foldable from a vertical position shown in solid lines a folded position shown in dashed lines. In the folded position, the vertical portion 183 may be substantially parallel to the upper surface 120. The right stopper structure 170 and/or the left stopper structure 180 may prevent the laptop computer 50 from sliding off of the upper surface 120 of the main body 110 in the rightward and leftward directions R, L.

The terms "a" and "an" do not denote a limitation of quantity, but rather denote the presence of at least one of the referenced items. The term "or" means "and/or" unless clearly indicated otherwise by context. Reference throughout the specification to "an aspect", means that a particular element (e.g., feature, structure, step, or characteristic) described in connection with the aspect is included in at least one aspect described herein, and may or may not be present in other aspects. In addition, it is to be understood that the described elements may be combined in any suitable manner in the various aspects.

When an element such as a layer, film, region, or substrate is referred to as being "on" another element, it can be directly on the other element or intervening elements may also be present. In contrast, when an element is referred to as being "directly on" another element, there are no intervening elements present.

Unless defined otherwise, technical, and scientific terms used herein have the same meaning as is commonly understood by one of skill in the art to which this disclosure belongs.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A laptop support device defining a forward direction, a rearward direction, a rightward direction, a leftward direction, an upward direction, and a downward direction, and comprising:

a main body shaped as a planar structure and comprising an upper surface that faces the upward direction and that is configured to hold a laptop computer; and a tension support strap attached to an upper surface of the main body at two locations that are within a rear 20% of the upper surface; and a backstop structure comprising a vertical portion configured to abut a rear end of the laptop computer to prevent the laptop computer from sliding in the rearward direction, wherein the tension support strap is configured to wrap around a user such that the tension support strap is tensioned between the main body and the user, wherein the rearward direction is directed away from the user and the forward direction is directed toward the user, and wherein the backstop structure is positioned within the rear 20% of the upper surface and extends continuously from a first position that is spaced from a left edge of the main body to a second position that is spaced from a right edge of the main body.

2. The laptop support device of claim 1, wherein the tension support strap is attached to the upper surface at two locations that are within a rear 10% of the upper surface.

3. The laptop support device of claim 1, wherein the backstop structure is positioned within a rear 10% of the upper surface.

4. The laptop support device of claim 1, wherein the backstop structure extends upward from a rear edge of the main body.

5. The laptop support device of claim 1, wherein a forward edge of the main body is curved.

6. The laptop support device of claim 1, further comprising a first attachment structure configured to attach to a first end of the tension support strap, and a second attachment structure configured to attach to a second end of the tension support strap.

7. The laptop support device of claim 6, further comprising a removable clasp structure disposed on the second attachment structure or the second end of the support strap.

8. The laptop support device of claim 7, wherein the removable clasp structure is a snap hook.

9. The laptop support device of claim 6, wherein the first attachment structure comprises a first ring portion configured to connect to a first attachment ring disposed at the first end of the tension support strap.

10. The laptop support device of claim 7, wherein the second attachment structure comprises a second ring portion configured to connect to a second attachment ring disposed at the end of the tension support strap with the removable clasp structure therebetween.

11. The laptop support device of claim 1, wherein the tension support strap is configured to be substantially parallel to the main body when in tensioned against the user.

12. The laptop support device of claim 1, wherein the tension support strap comprises a strap body and a length adjustment mechanism configured to adjust a length of the strap body.

13. The laptop support device of claim 1, wherein the vertical portion of the backstop structure extends directly from the upper surface of the main body.

14. The laptop support device of claim 13, wherein the vertical portion of the backstop structure is formed integrally with the main body.

15. The laptop support device of claim 1, wherein the vertical portion of the backstop structure is rotatably mounted on the main body via a hinge and configured to rotate between a vertical position and a folded position.

16. A laptop support device defining a forward direction, a rearward direction, a rightward direction, a leftward direction, an upward direction, and a downward direction, and comprising:

a main body shaped as a planar structure and comprising an upper surface that faces the upward direction and that is configured to hold a laptop computer, and a forward edge that is curved;

a backstop structure formed on the upper surface of the main body and positioned within a rear 10% of the upper surface, the backstop structure comprising a vertical portion configured to abut a rear end of the laptop computer to prevent the laptop computer from sliding in the rearward direction;

a tension support strap configured to be attached to the upper surface of the main body at two locations that are within the rear 10% of the upper surface, the tension support strap being configured to wrap around a user such that the tension support strap is tensioned between the main body and the user, the tension support strap comprising a strap body and a length adjustment mechanism configured to adjust a length of the strap body, and the tension support strap being configured to be substantially parallel to the main body when in tensioned against the user;

a first attachment structure configured to attach to a first end of the tension support strap and comprising a first ring portion configured to connect to a first attachment ring disposed at the first end of the tension support strap; and a second attachment structure configured to attach to a second end of the tension support strap and comprising a second ring portion configured to connect to a second attachment ring disposed at the end of the tension support strap with a removable clasp structure structured as a snap hook therebetween, wherein the rearward direction is directed away from the user and the forward direction is directed toward the user, and wherein the backstop structure extends continuously from a first position that is spaced from a left edge of the main body to a second position that is spaced from a right edge of the main body.

17. The laptop support device of claim 1, wherein at least a portion of the backstop is disposed directly between the two locations on the upper surface of the main body at which the tension support is attached.

18. The laptop support device of claim 16, wherein at least a portion of the backstop is disposed directly between the two locations on the upper surface of the main body at which the tension support is attached.

19. The laptop support device of claim 1, wherein no other strap is attached to the main body.

20. The laptop support device of claim 1, wherein no other strap is attached to the main body.

* * * * *